United States Patent [19]

Brücher et al.

[11] Patent Number: 4,848,449

[45] Date of Patent: Jul. 18, 1989

[54] HEAT EXCHANGER, ESPECIALLY FOR COOLING CRACKED GAS

[75] Inventors: Peter Brücher; Helmut Lachmann, both of Berlin, Fed. Rep. of Germany

[73] Assignee: Borsig GmbH, Berlin, Fed. Rep. of Germany

[21] Appl. No.: 193,244

[22] Filed: May 11, 1988

[30] Foreign Application Priority Data

May 12, 1987 [DE] Fed. Rep. of Germany ..... 3715712

[51] Int. Cl.[4] ..... F28F 9/22

[52] U.S. Cl. ..... 165/160; 165/134.1

[58] Field of Search ..... 165/134.1, 160

[56] References Cited

U.S. PATENT DOCUMENTS

| | | | |
|---|---|---|---|
| 3,117,559 | 1/1964 | Fouche | 165/160 X |
| 3,820,598 | 6/1974 | Fenger et al. | 165/160 |
| 4,336,770 | 6/1982 | Kaneko et al. | 165/160 X |
| 4,570,702 | 2/1986 | Stafford et al. | 165/160 X |
| 4,585,057 | 4/1986 | Marburger | 165/134.1 |
| 4,589,473 | 5/1986 | Kehrer | 165/160 X |
| 4,770,239 | 9/1988 | Duponteil | 165/134.1 |

FOREIGN PATENT DOCUMENTS

| | | | |
|---|---|---|---|
| 1158706 | 6/1958 | France | 165/160 |

*Primary Examiner*—Margaret A. Focarino

*Attorney, Agent, or Firm*—Max Fogiel

[57] ABSTRACT

The gas-conveying pipes (8) of a heat exchanger employed to cool cracked gas are surrounded by and communicate with outer pipes (9). The outer pipes are welded into pipe slabs (4 and 5) and not only a convey a coolant but also secure the pipe slabs (4 and 5), which can accordingly by thin.

8 Claims, 3 Drawing Sheets

HEAT EXCHANGER, ESPECIALLY FOR COOLING CRACKED GAS

Figure 1:
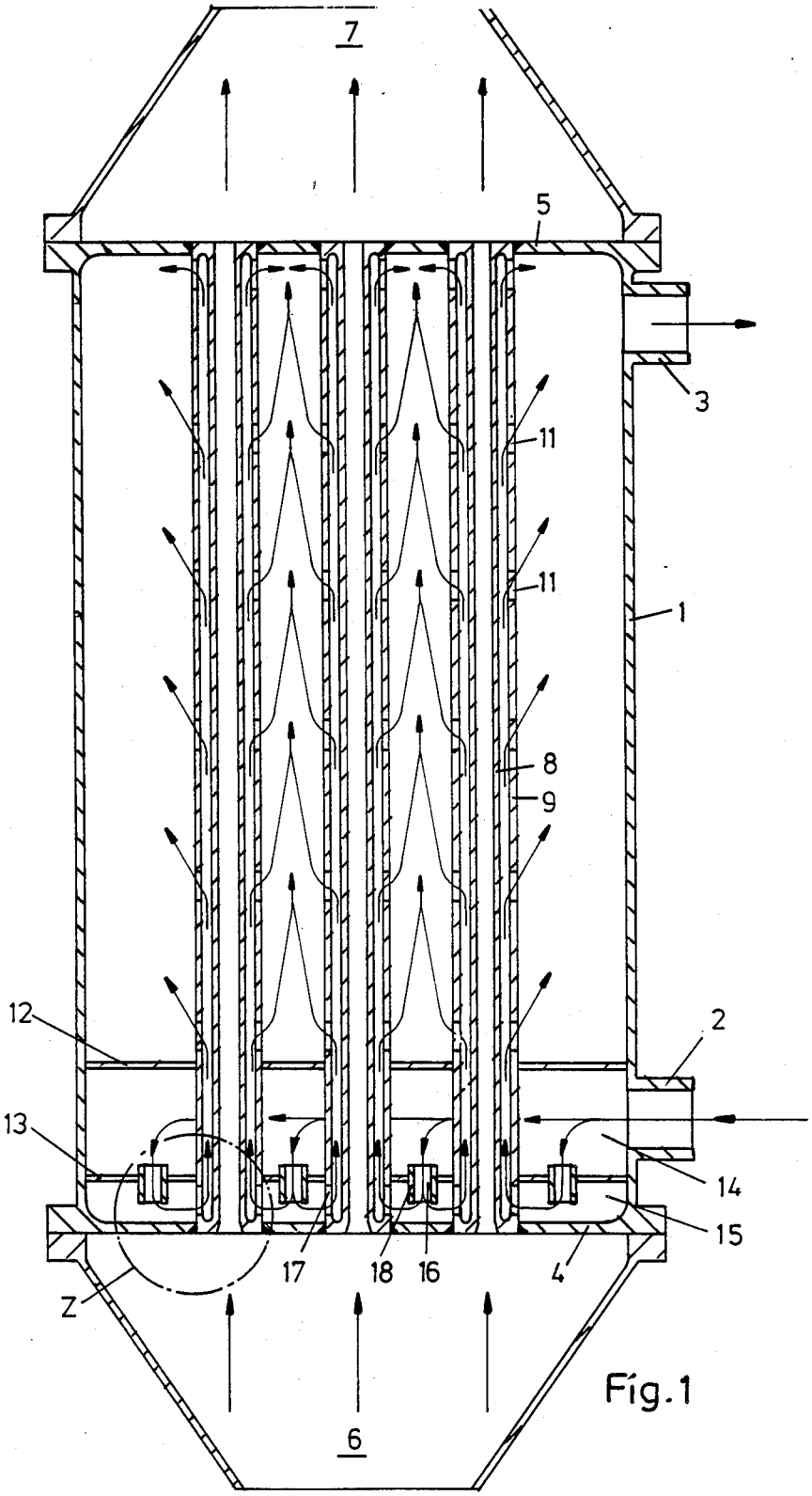

The invention concerns a heat exchanger, especially for cooling cracked gas, with the characteristics recited in the preamble to claim 1.

Heat exchangers of this type need to be designed with the partitions between the hot and heat-radiating gas and the heat-absorbing coolant, which is subject to high pressure, as thin as possible in order to prevent thermal stress and keep the temperature of the partitions low. Another requisite is to always ensure a sufficient supply of coolant to every surface that participates in the heat exchange subject to every operating condition while simultaneously keeping the coolant flowing rapidly, especially over the horizontal exchange surfaces. Rapid flow is essential to prevent particles in the coolant from depositing on the partitions and overheating them.

This requisite is attained in a known pipe-nest heat exchanger (German Pat. No. 3 533 219) by making the slab of pipes at the gas-intake end thin and supporting it on fingers and on a plate. A lot of the coolant that is fed into the heat exchanger is conveyed through the space between the thin pipe slab and the supporting plate in order to cool the pipe slab. Although this design has been proven in practice, the supporting plate makes it expensive to build.

The object of the invention is to simplify the generic heat exchanger to the extent that it will be as inexpensive as possible to build while having walls that are as thin as possible.

This object is attained in a generic heat exchanger by the characteristics recited in claim 1 or 2. Practical embodiments of the invention are recited in the subsidiary claims.

The function of the outer pipes in the heat exchanger in accordance with the invention is not only to channel the flow but also to support the structure by, in conjunction with the jacket, securing the two pipe slabs together. The pipe slabs can accordingly, in spite of the high pressure at the coolant end, be very thin without needing additional securement, support, or retainers because the high pressure exerted on the pipe slabs is accommodated in the form of tension by the outer pipes. Since the outer pipes attain the same wall temperature as the jacket, tension resulting from differences between the thermal expansion of the jacket, the outer pipes, and the pipe slabs are avoided. Since the tension resulting from the difference between the expansion of the inner and outer pipes is accommodated by the design and dimensioning of the connections between the ends of the pipes, the difference is not transmitted to the pipe slabs or to the pipe-end connections.

Two embodiments of the invention are illustrated in the drawing and will now be described in detail.

Figure 2:
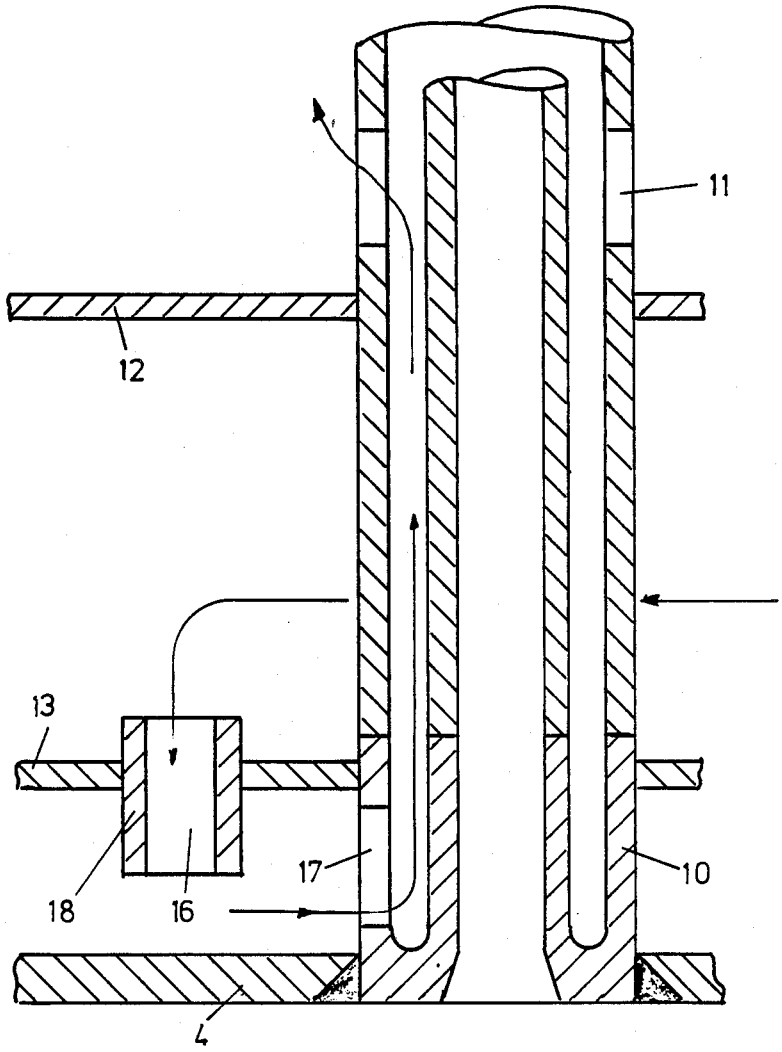
Figure 3:
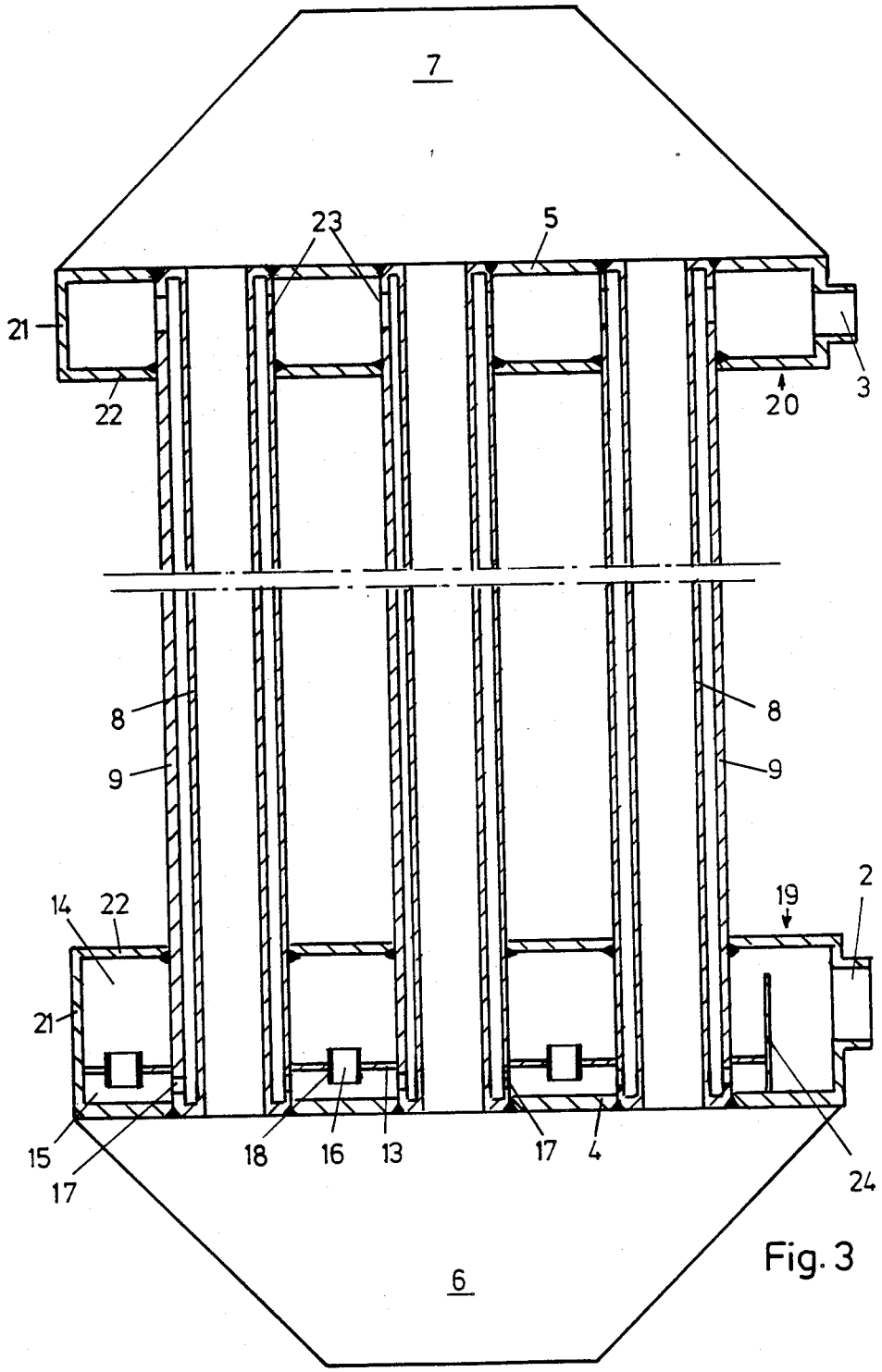

FIG. 1 is a longitudinal section through a heat exchanger in accordance with the invention, FIG. 2 is a larger-scale illustration of the detail Z in FIG. 1, and FIG. 3 is a longitudinal section through another embodiment of the heat exchanger in accordance with the invention.

A heat exchanger for cooling cracked gas consists of a cylindrical jacket 1 that has an intake 2 and an outlet 3 for coolant. The coolant is boiling water that is fed at high pressure into the space surrounded by jacket 1.

Jacket 1 has a thin pipe slab 4 and 5 at each end. Communicating with pipe slabs 4 and 5 are a gas-intake chamber 6 on one side and a gas-outlet chamber 7 on the other. Gas-intake chamber 6 communicates with gas-outlet chamber 7 through pipes that extend through the inside of jacket 1.

Each pipe is double, consisting of a gas-conveying inner pipe 8 surrounded by an outer pipe 9, with a space left between them. Inner pipe 8 is connected to outer pipe 9 by means of a shape 10 welded into pipe slab 4 at the end of the outer pipe. The welding seam is accordingly outside the flow of gas entering inner pipe 8. Outer pipe 9 has access openings 11 at various levels, with the ultimate opening in the immediate vicinity of a pipe slab 5 at the gas-outlet end. Outer pipes 9 accordingly not only channel the coolant but also support the thin pipe slabs 4 and 5.

To ensure that the pipe slab 4 at the gas-intake end is effectively cooled, two separating sheets 12 and 13 with double-walled pipes extending through them are positioned parallel to the slab. Separating sheets 12 and 13 demarcate in conjunction with jacket 1 an inflow chamber 14, into which intakes 2 open. Second separating sheet 13 constitutes in conjunction with pipe slab 4 an outflow chamber 15 that is a multiple smaller in capacity than inflow chamber 14. The ratio between their capacities can for example be 1:4.

Second separating sheet 13 is provided with flow-through openings 16 between each pair of double-walled pipes. The cross-section of flow-through openings 16 is large enough for the coolant to flow considerably more rapidly through them than through inflow chamber 14.

The section of outer pipe 9 or of shape 10 located within outflow chamber 15 is provided with intake openings 17, through which the coolant enters the annular space inside the double pipes. The coolant flows out of the annular gap through access openings 11 into the space surrounded by jacket 1, whence it is removed through outlet 3. The coolant flows more slowly inside inflow chamber 14, which is of approximately the same capacity. The coolant is accelerated as it flows through flow-through openings 16. This principle of a low pressure loss as the result of a low rate of flow through inflow chamber 14 followed by a higher pressure loss as the result of a higher rate of flow through the flow-through openings 16 in second separating sheet 13 ensures that the same volume of coolant will flow through all the flow-through openings 16 no matter how close to or far from intake 2 a particular flow-through opening 16 is, and each double pipe is accordingly provided with the same volume of coolant.

Inserted into flow-through openings 16 are sleeves 18 that project beyond both sides of separating sheet 13. The upper projecting edge of sleeves 18 prevents the entrainment of any particles that travel along with the coolant and settle on separating sheet 13. The lower section of sleeves 18 channels the coolant directly to pipe slab 4, whence it flows rapidly along pipe slab 4 to the intake openings 17 in the double pipes. The coolant also flows rapidly through intake openings 17 into the annular gap in the double pipes.

The heat exchanger illustrated in FIG. 3 has two terminal chambers 19 and 20, one of which is provided with intakes 2 and the other with outlets 3 for the supply and removal of coolant. Terminal chambers 19 and 20 communicate through double-walled pipes, which consist of gas-conveying inner pipes 8 and of outer pipes 9, and open into either gas-intake chamber 6 or gas-outlet chamber 7. The gas end of each terminal chamber 19 and 20 contains one of the aforesaid pipe slabs 4 or 5, which are connected to another slab 22 by way of a wall 21. Outer pipes 9 are welded into slabs 4, 5, and 22, securing them. The section of outer pipes 9 inside terminal chambers 19 and 20 are provided with intake openings 17 and outlet openings 23.

The terminal chamber 19 at the gas-intake end is divided by a separating sheet 13 provided with flow-through openings 16 into a large-capacity inflow chamber 14 and a small-capacity outflow chamber 15. Connected to separating sheet 13 is an overflow weir 24 mounted on pipe slab 4. The coolant supplied to terminal chamber 19 through intake 2 arrives in inflow chamber 14 through overflow weir 24 and is accelerated into outflow chamber 15 and through the intake openings 17 in the annular space inside the double pipes and through outlet openings 23 into the other terminal chamber 20, whence it is removed through outlets 3.

Although the invention has been specified in terms of upright cracked-gas coolers, it can also be employed with recumbent types.

We claim:

1. A heat exchanger for cooling cracked gas, comprising: a gas-intake chamber and a gas-outlet chamber communicating with one another through gas-conveying tubes; tube supporting sheets bordering said chambers; each tube supporting sheet having said tubes extending therethrough; a jacket accommodating said tubes and having an intake and an outlet, said tube supporting sheets communicating with said jacket, said jacket having an interior space for cooling medium to flow there-through; an outer tube surrounding each gas-conveying tube and having access openings, an annular gap being left between said outer tube and said gas-conveying tubes, said gas-conveying tube being connected with said outer tube, said outer tube being welded into said tube sheets; one of said tube sheets bordering said gas intake chamber; an additional tube sheet; an end chamber for conducting cooling medium formed by said additional tube sheet and said one tube sheet bordering said gas intake chamber; a separating sheet inside said end chamber and forming an inflow chamber and an outflow chamber; said separating sheet having flow-through openings and positioned remote from one tube sheet at the gas-intake chamber; said outside tube having a section with intake openings in said outflow chamber; said inflow chamber on a side of said separating sheet facing away from said one tube sheet at the gas-intake chamber; said intake of said jacket opening into said inflow chamber; said inflow chamber having a capacity greater than the capacity of said outflow chamber by a whole factor.

2. A heat exchanger as defined in claim 1, wherein flow acceleration of said cooling medium is dependent on the ratio of the cross-section of said flow-through openings of said separating sheet to the cross-section of said inflow chamber.

3. A heat exchanger as defined in claim 1, including sleeves inserted into said flow-through openings of said separating sheet, said sleeves projecting beyond both sides of said separating sheet.

4. A heat exchanger for cooling cracked gas comprising: a gas-inlet chamber and a gas-outlet chamber; gas conducting tubes connecting said gas-inlet chamber with said gas-outlet chamber; a tube sheet bordering each chamber; an additional tube sheet forming with at least the tube sheet bordering the gas-inlet chamber an end chamber for conducting cooling medium; an outer tube surrounding each gas conducting tube with an annular gap therebetween; said outer tube being welded into the tube sheet bordering said gas-inlet chamber and being connected to the respective gas-conducting tube; a separating sheet spaced from the tube sheet bordering said gas-inlet chamber and having flow-through openings for forming a flow-out chamber; said outer tube having a part with inlet openings lying within said flow-out chamber; a flow-in chamber on a side of said separating sheet facing away from said tube sheet bordering said gas-inlet chamber; an entrance connection in said flow-in chamber; said flow-in chamber having a volume that is larger by several orders of magnitude than the volume of said flow-out chamber; each said annular gap being supplied with the same amount of cooling medium independent of the spacing between said gap and said entrance connection; said tube sheets bordering said gas-inlet chamber and said gas-outlet chamber being connected to one another through said outer tube.

5. A heat exchanger as defined in claim 4, wherein the tube sheet bordering said gas-outlet chamber forms an end chamber with a further tube sheet for conducting away said cooling medium; said outer tube being welded in said tube sheets bordering said gas-inlet chamber and said gas-outlet chamber and said further tube sheet, said tube sheets of said gas-inlet chamber and said gas-outlet chamber and said further tube sheet being thin-walled tube sheets.

6. A heat exchanger as defined in claim 4, including jacket means enclosing said gas-conveying tubes for forming an interior space to circulate said cooling medium, said jacket means having entrance connection means and exit connection means connected to said tube sheets bordering said gas-inlet chamber and said gas-outlet chamber, said outer tube being welded into said tube sheets bordering said gas-inlet chamber and said gas-outlet chamber; said outer tube having a part lying within said interior space of said jacket means, said part of said outer tube having flow-through openings, said tube sheets bordering said gas-inlet chamber and said gas-outlet chamber comprising thin-walled tube sheets.

7. A heat exchanger as defined in claim 4, wherein said flow-through openings of said separating sheet have a cross-section in relation to the cross-section of said inflow chamber for increasing the flow velocity of said cooling medium.

8. A heat exchanger as defined in claim 4, including tubular sleeves inserted into said flow-through openings of said separating sheet, said sleeves projecting from both sides of said separating sheet.

* * * * *